US010889137B2

(12) United States Patent
Sasaki

(10) Patent No.: US 10,889,137 B2
(45) Date of Patent: Jan. 12, 2021

(54) TAPE CARTRIDGE

(71) Applicant: Seiko Epson Corporation, Tokyo (JP)

(72) Inventor: Taishi Sasaki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 54 days.

(21) Appl. No.: 15/559,422

(22) PCT Filed: Mar. 16, 2016

(86) PCT No.: PCT/JP2016/058403
§ 371 (c)(1),
(2) Date: Sep. 18, 2017

(87) PCT Pub. No.: WO2016/148211
PCT Pub. Date: Sep. 22, 2016

(65) Prior Publication Data

US 2018/0079239 A1 Mar. 22, 2018

(30) Foreign Application Priority Data

Mar. 19, 2015 (JP) ..... 2015-055822

(51) Int. Cl.

| | |
|---|---|
| ***B41J 15/04*** | (2006.01) |
| ***B41J 32/00*** | (2006.01) |
| ***B41J 2/325*** | (2006.01) |
| ***B41J 3/36*** | (2006.01) |
| ***B41J 17/32*** | (2006.01) |

(Continued)

(52) U.S. Cl.

CPC ..... *B41J 15/046* (2013.01); *B41J 2/325* (2013.01); *B41J 3/36* (2013.01); *B41J 15/04* (2013.01); *B41J 15/044* (2013.01); *B41J 17/32* (2013.01); *B41J 32/00* (2013.01); *B41J 33/003* (2013.01); *B41J 33/52* (2013.01); *B41J 35/28* (2013.01)

(58) Field of Classification Search

None

See application file for complete search history.

(56) References Cited

U.S. PATENT DOCUMENTS

| | | | |
|---|---|---|---|
| 4,984,915 | A | 1/1991 | Tashiro et al. |
| 5,056,940 | A | 10/1991 | Basile |

(Continued)

FOREIGN PATENT DOCUMENTS

| | | | |
|---|---|---|---|
| JP | H03-031152 | A | 2/1991 |
| JP | H05-286217 | A | 11/1993 |

(Continued)

*Primary Examiner* — Jill E Culler

(74) *Attorney, Agent, or Firm* — Oliff PLC

(57) ABSTRACT

A tape cartridge mounted to a tape printer includes a ribbon feeding core on which an ink ribbon is wound so as to be capable of being fed and a ribbon winding core that winds the ink ribbon fed from the ribbon feeding core. In the tape cartridge, the ribbon feeding core includes a core body that winds the ink ribbon and a shaft engaging part formed at an end portion of the core body and engaged with a feeding-side driving shaft of the tape printer. The shaft engaging part protrudes in an axial direction of the core body from an end surface of the core body and is formed in a crown shape in which a plurality of convex portions and a plurality of concave portions are alternately arranged side by side in a circumferential direction.

4 Claims, 5 Drawing Sheets

(51) Int. Cl.

| | |
|---|---|
| ***B41J 33/00*** | (2006.01) |
| ***B41J 35/28*** | (2006.01) |
| ***B41J 33/52*** | (2006.01) |

(56) References Cited

U.S. PATENT DOCUMENTS

| | | | | |
|---|---|---|---|---|
| 5,702,192 | A | 12/1997 | Matsuhashi et al. | |
| 5,931,588 | A | 8/1999 | Kanai | |
| 6,478,486 | B1 * | 11/2002 | Ando | B41J 17/02 400/223 |
| 2001/0046399 | A1 * | 11/2001 | Hayashi | B41J 2/325 400/207 |
| 2004/0146331 | A1 * | 7/2004 | McNestry | B41J 2/325 400/615.2 |
| 2005/0129444 | A1 * | 6/2005 | Igi | B41J 17/24 400/207 |
| 2012/0080550 | A1 * | 4/2012 | Yamaguchi | B41J 3/4075 242/160.4 |
| 2012/0170959 | A1 | 7/2012 | Vandermeulen et al. | |
| 2016/0368294 | A1 * | 12/2016 | Sakano | B41J 17/36 |
| 2018/0079239 | A1 | 3/2018 | Sasaki | |

FOREIGN PATENT DOCUMENTS

| | | | |
|---|---|---|---|
| JP | H07-178992 | A | 7/1995 |
| JP | H08-052913 | A | 2/1996 |
| JP | H10-203732 | A | 8/1998 |
| JP | 2000-108472 | A | 4/2000 |
| JP | 2004-189304 | A | 7/2004 |
| JP | 2009-006662 | A | 1/2009 |
| JP | 2010-125728 | A | 6/2010 |
| JP | 2010-162736 | A | 7/2010 |
| JP | 2010-162756 | A | 7/2010 |
| JP | 2015-009437 | A | 1/2015 |
| JP | 2016-175221 | A | 10/2016 |
| WO | WO-03/072366 | A1 | 9/2003 |

* cited by examiner

TAPE CARTRIDGE

TECHNICAL FIELD

The present invention relates to a tape cartridge mounted to a tape printer.

BACKGROUND ART in the related art, as this kind of tape cartridge, there has been known a tape cartridge including a ribbon feeding core, which is engaged with a feeding-side driving shaft (a ribbon rewinding shaft) of a tape printer and on which an ink ribbon is wound so as to be capable of being fed, and a ribbon winding core which is engaged with a winding-side driving shaft (a ribbon winding shaft) of the tape printer and winds the ink ribbon fed from the ribbon feeding core (see Patent Literature 1). The feeding-side driving shaft of the tape printer serves as a spline shaft, and the ribbon feeding core is provided on the inner surface thereof with a spline-shaped engaging piece engaged with the spline shaft. That is, the spline shaft of the feeding-side driving shaft side and the engaging piece of the ribbon feeding core side are engaged with each other, so that the ribbon feeding core is rotated by the feeding-side driving shaft. In this way, the ink ribbon fed from the ribbon feeding core once can be rewound on the ribbon feeding core.

CITATION LIST

Patent Literature

[Patent Literature 1]: JP-A-2010-162736

SUMMARY OF INVENTION

Technical Problem

In this kind of tape cartridge, it is general that a tension spring is embedded in the feeding-side driving shaft to apply predetermined tension to the ink ribbon fed from the ribbon feeding core. Therefore, the ribbon feeding core is configured to rewind the ink ribbon against urging force of the tension spring, and in order to rotate the ribbon feeding core, strong force is required as compared with the case of rotating the ribbon winding core.

However, in the aforementioned related tape cartridge, the engaging piece of the ribbon feeding core is formed to protrude inward from the inner surface of the ribbon feeding core. Therefore, the engaging piece is engaged with the feeding-side driving shaft at the inner side of the ribbon feeding core, so that an engagement position between the feeding-side driving shaft and the ribbon feeding core is positioned at an inner side of a radial direction. In this way, there is a problem that force for rotating the ribbon feeding core becomes weak in view of "the principle of a lever". As a consequence, it is not possible to appropriately rewind the ink ribbon.

In this regard, it is considered to move the aforementioned engagement position to the outside in a radial direction by enlarging the ribbon winding core in the radial direction. However, in this case, there is a problem that the amount of the ink ribbon woundable on the ribbon feeding core is reduced in view of enlargement of the tape cartridge and an arrangement space.

Solution to Problem

The present invention provides a tape cartridge capable of moving an engagement position between a ribbon feeding core and a feeding-side driving shaft to the outside in a radial direction without enlarging the ribbon winding core in the radial direction.

A tape cartridge of the present invention is a tape cartridge mounted to a tape printer, and includes a ribbon feeding core on which an ink ribbon is wound so as to be capable of being fed, and a ribbon winding core that winds the ink ribbon fed from the ribbon feeding core, wherein the ribbon feeding core includes a core body that winds the ink ribbon, and a shaft engaging part formed at an end portion of the core body and engaged with a feeding-side driving shaft of the tape printer, wherein the shaft engaging part protrudes in an axial direction from an end surface of the core body and is formed in a crown shape in which a plurality of convex portions and a plurality of concave portions are alternately arranged side by side in a circumferential direction.

According to the configuration, the crown shaft engaging part protruding from the end surface of the core body is configured to be engaged with the feeding-side driving shaft, so that it is possible to allow the ribbon feeding core to be engaged with the feeding-side driving shaft at a radial outside as much as possible. In this way, it is possible to move an engagement position between the ribbon feeding core and the feeding-side driving shaft to the outside in the radial direction without enlarging the ribbon feeding core in the radial direction. In this way, the ink ribbon can be appropriately rewound.

In this case, preferably, each convex portion is formed at a distal end portion in the axial direction thereof with a guide slope that guides a spline convex part of the feeding-side driving shaft into the concave portion when the tape cartridge is mounted to the tape printer.

According to the configuration, when the tape cartridge is mounted to the tape printer, it is possible to allow the ribbon feeding core to be smoothly engaged with the feeding-side driving shaft.

Furthermore, preferably, the tape cartridge further includes a rotation stop part that stops rotation of the ribbon feeding core in engagement with the shaft engaging part when the tape cartridge is not mounted.

According to the configuration, the shaft engaging part is also used as a part with which the rotation stop part is engaged, so that it is possible to simplify the configuration of the tape cartridge.

Preferably, the ribbon winding core has a winding-side shaft engaging part engaged with a winding-side driving shaft of the tape printer, and the shaft engaging part and the winding-side shaft engaging part are formed such that an engagement timing, at which the shaft engaging part is engaged with the feeding-side driving shaft, and an engagement timing, at which the winding-side shaft engaging part is engaged with the winding-side driving shaft, when the tape cartridge is mounted to the tape printer are different from each other.

According to the configuration, when the tape cartridge is mounted to the tape printer, it is possible to avoid the engagement of the shaft engaging part with respect to the feeding-side driving shaft and the engagement of the winding-side shaft engaging part with respect to the winding-side driving shaft from being simultaneously performed. In this way, it is possible to avoid a problem that a heavy load occurs in the ink ribbon or each engagement is not normally performed due to simultaneous generation of force for allowing the shaft engaging part to be engaged with the feeding-side driving shaft and force for allowing the winding-side shaft engaging part to be engaged with the winding-side driving shaft.

DESCRIPTION OF EMBODIMENTS

Hereinafter, with reference to the accompanying drawings, a tape cartridge according to an embodiment of the present invention and a tape printer mounted with the same will be described. The tape printer performs printing while feeding a printing tape and an ink ribbon from the mounted tape cartridge, cuts a printed part of the printing tape, and creates a label (a tape piece).

Figure 1:
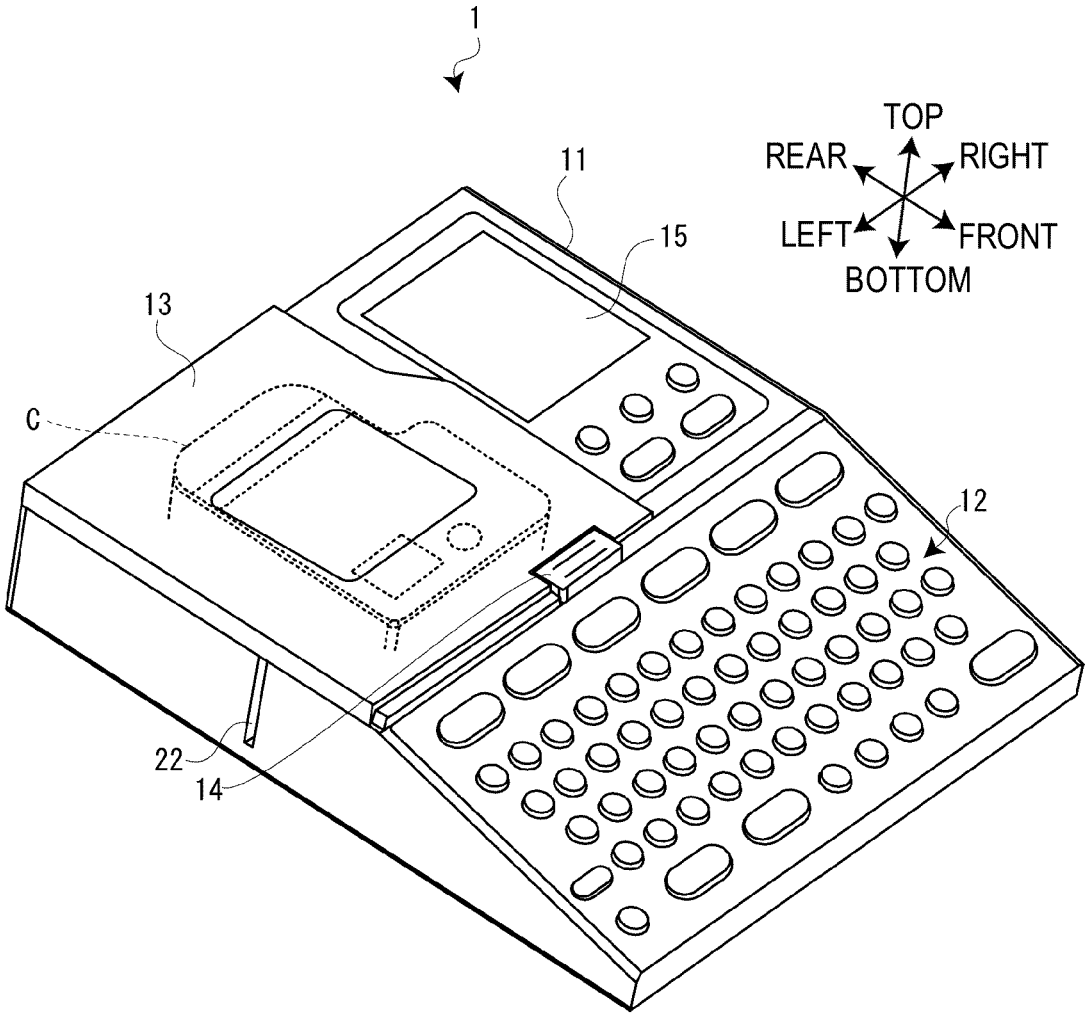
FIG. 1 is an external appearance perspective view illustrating a tape printer in a lid closed state according to the present embodiment.
Figure 2:
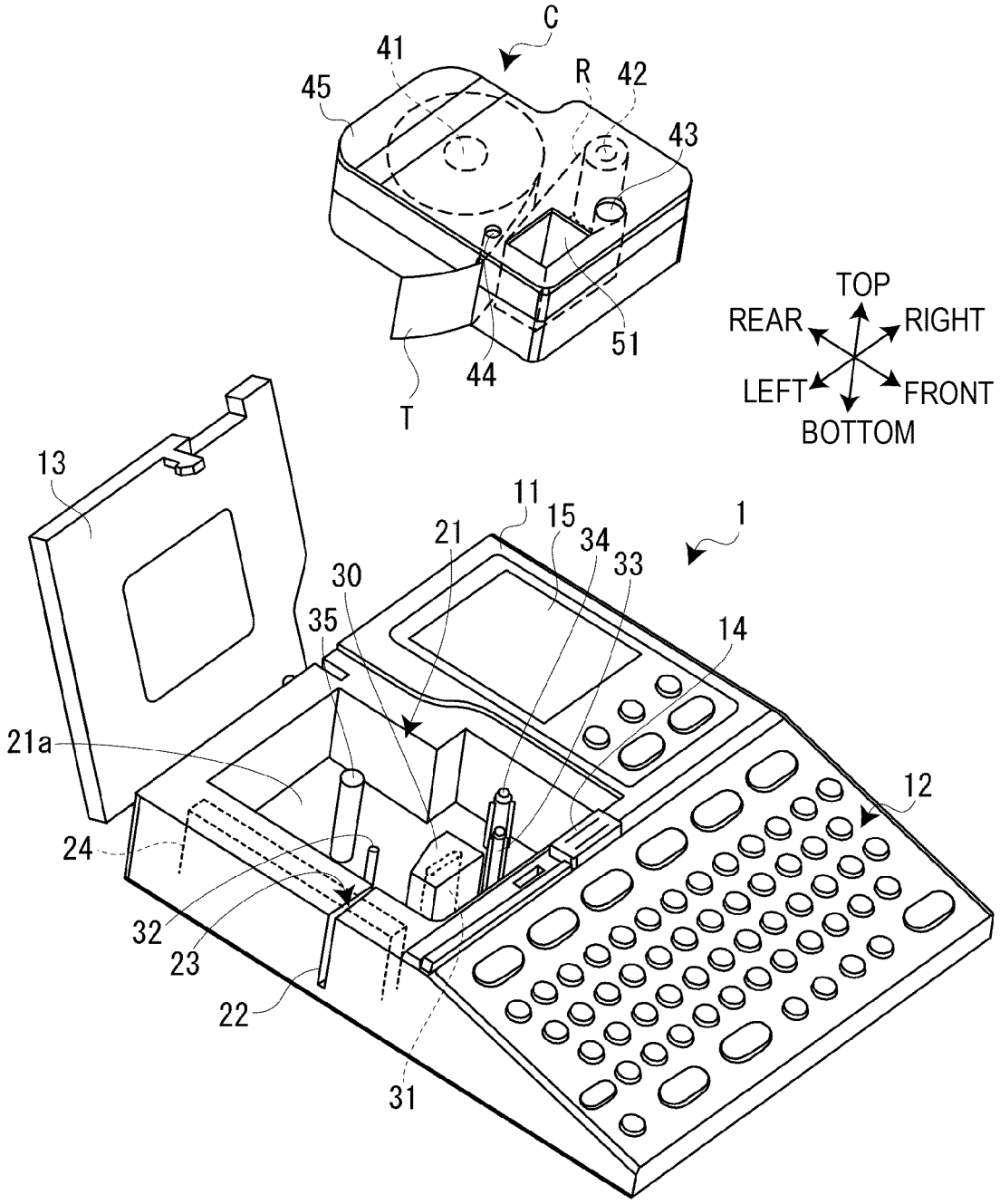
FIG. 2 is an external appearance perspective view illustrating a tape printer in a lid opened state.

As illustrated in FIG. 1 and FIG. 2, in a tape printer 1, an outer shell is formed by a device case 11 and a keyboard 12 including various keys is arranged on an upper surface of a front half part of the device case 11. An openable lid 13 is widely provided on a left upper surface of a rear half part of the device case 11, and at a front side of the openable lid 13, a lid opening button 14 is provided to open the openable lid 13. On a right upper surface of the rear half part of the device case 11, a rectangular display 15 is arranged to display an input result and the like from the keyboard 12.

When the lid opening button 14 is pressed to open the openable lid 13, a cartridge mounting part 21 is hollow-formed inside the openable lid 13 such that a tape cartridge C is freely detachable. The tape cartridge C is mounted to the cartridge mounting part 21 in the state in which the openable lid 13 has opened.

At a left side of the device case 11, a tape discharge port 22 connected to the cartridge mounting part 21 is formed, and between the cartridge mounting part 21 and the tape discharge port 22, a tape discharge path 23 is formed. Inside the device case 11, a tape cutter 24 is embedded to face the tape discharge path 23.

Figure 3:
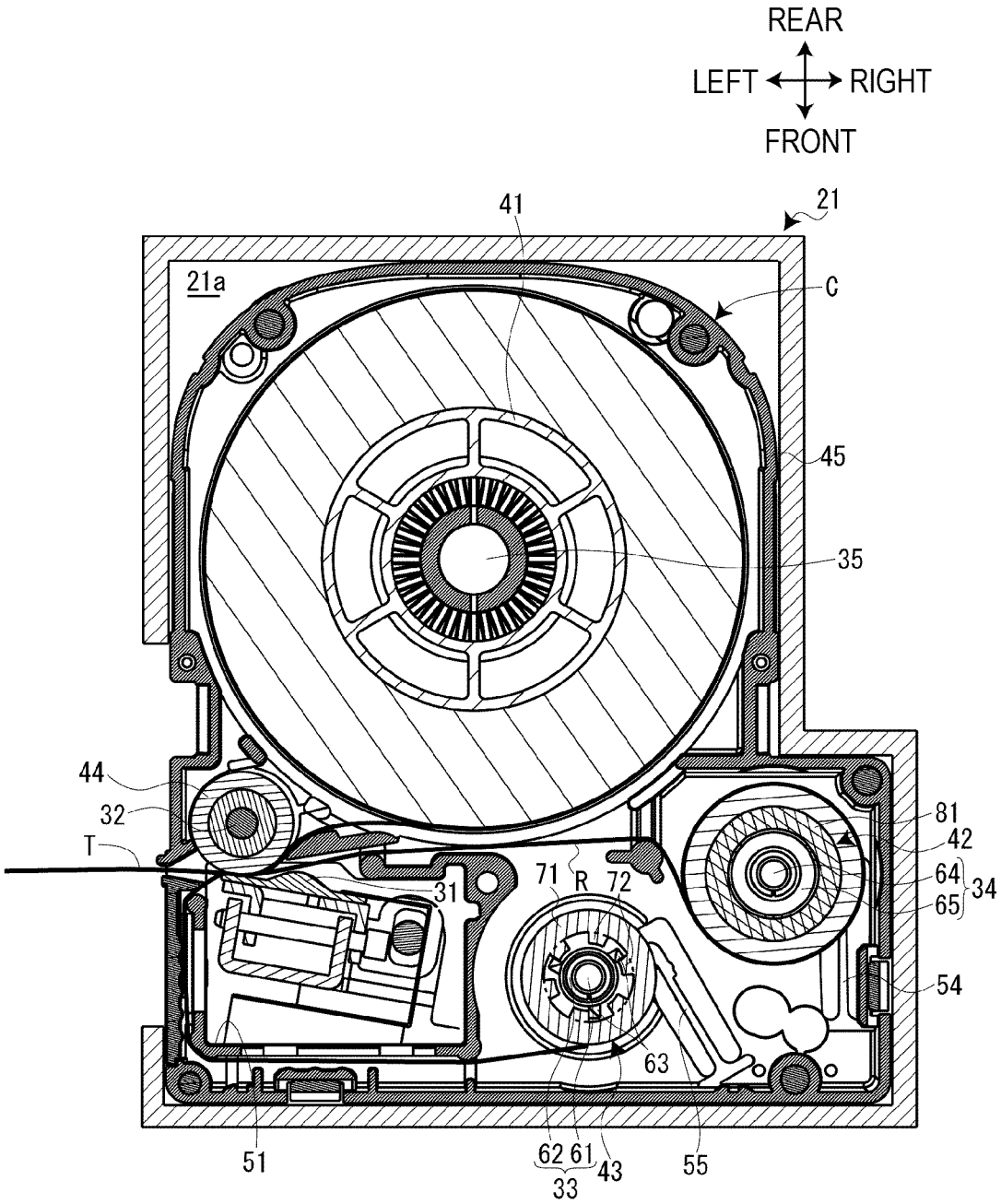
FIG. 3 is a plane sectional view illustrating a cartridge mounting part and a tape cartridge mounted to the same.

As illustrated in FIG. 2 and FIG. 3, the cartridge mounting part 21 is provided with a thermal type printing head 31 received in a head cover 30, a platen driving shaft 32 facing the printing head 31, a winding-side driving shaft 33 engaged with a ribbon winding core 43 to be described later, a feeding-side driving shaft 34 engaged with a ribbon feeding core 42 to be described later, and a positioning protrusion 35 of a tape reel 41 to be described later. FIG. 3 is a plane sectional view taken at a center position of the tape cartridge C in a vertical direction. The platen driving shaft 32, the winding-side driving shaft 33, and the feeding-side driving shaft 34 pass through a bottom plate 21*a* of the cartridge mounting part 21, and in a lower space of the bottom plate 21*a*, a feeding power system (not illustrated) is arranged to drive the platen driving shaft 32, the winding-side driving shaft 33, and the feeding-side driving shaft 34. Details of the winding-side driving shaft 33 and the feeding-side driving shaft 34 will be described later.

The printing head 31 is configured with a thermal printing head in which a plurality of heating elements (not illustrated) are vertically arranged in line. That is, the printing head 31 separately heat-drives the heating elements in the state of pressing a printing tape T and an ink ribbon R between the printing head 31 and a platen roller 44 to be described later, thereby thermally transferring ink on the ink ribbon R to the printing tape T in units of dots.

The tape cartridge C has the tape reel 41 on which the printing tape T is wound so as to be capable of being fed, the ribbon feeding core 42 on which the ink ribbon R is wound so as to be capable of being fed, the ribbon winding core 43 that winds the ink ribbon R fed from the ribbon feeding core 42, the platen roller 44 that faces the printing head 31, and a cartridge case 45 that receives these elements. Details of the ribbon feeding core 42 and the ribbon winding core 43 will be described later.

In the cartridge case 45, a head opening 51 is through-formed to allow a head cover 30 to be inserted therethrough. Although not illustrated, the cartridge case 45 is formed at the ceiling wall and the bottom wall thereof with a pair of upper and lower feeding-side core receiving parts for rotatably supporting the ribbon feeding core 42, and a pair of upper and lower winding-side core receiving parts for rotatably supporting the ribbon winding core 43. The core receiving parts of the bottom wall side are formed with insertion openings 52 and 53 through which the driving shafts 33 and 34 are respectively inserted (see FIG. 4).

Figure 4:
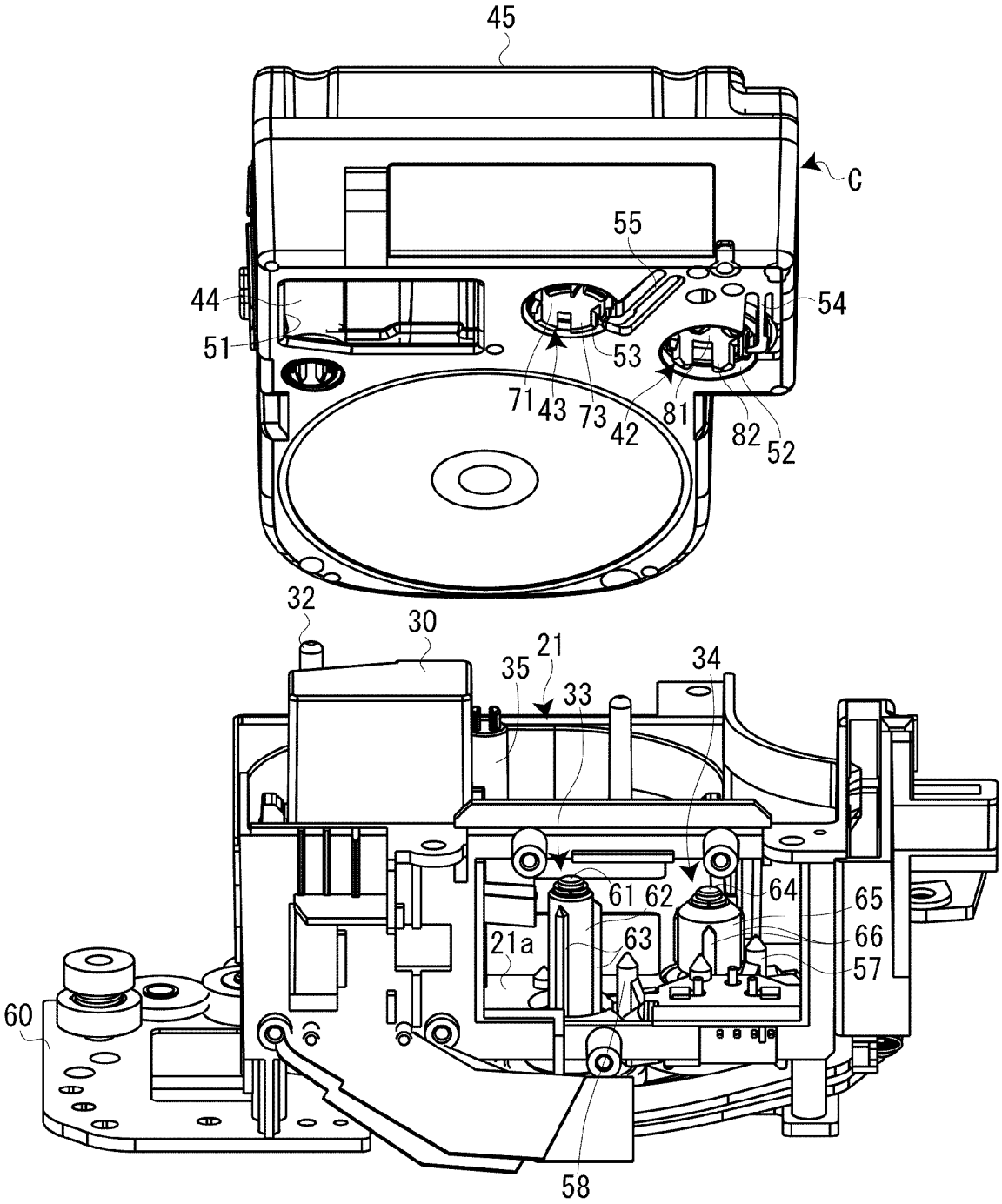
FIG. 4 is a perspective view illustrating a cartridge mounting part and a tape cartridge.

As illustrated in FIG. 3 and FIG. 4, the cartridge case 45 is formed at the bottom wall thereof with a first rotation stop hook 54 (a rotation stop part) and a second rotation stop hook 55 that respectively face the insertion openings 52 and 53. The first rotation stop hook 54 is engaged with the ribbon feeding core 42 to stop the rotation of the ribbon feeding core 42. On the other hand, the second rotation stop hook 55 is engaged with the ribbon winding core 43 to stop the rotation of the ribbon winding core 43.

When the tape cartridge C is mounted to the cartridge mounting part 21, the head opening 51 is inserted around the head cover 30, so that the center hole of the tape reel 41 is inserted around the positioning protrusion 35. Simultaneously to this, the center hole of the platen roller 44 is fitted around the platen driving shaft 32, the center hole of the ribbon winding core 43 is fitted around the winding-side driving shaft 33, and the center hole of the ribbon feeding core 42 is fitted around the feeding-side driving shaft 34. In this way, the platen roller 44 is engaged with the platen driving shaft 32, the ribbon winding core 43 is engaged with the winding-side driving shaft 33, and the ribbon feeding core 42 is engaged with the feeding-side driving shaft 34. In this case, the first rotation stop hook 54 and the second rotation stop hook 55 are respectively engaged with two engagement releasing protrusions 57 and 58 (see FIG. 4) formed at the bottom plate 21*a* of the cartridge mounting part 21 and having a conical distal end, so that engagement and rotation stop for the ribbon feeding core 42 and the ribbon winding core 43 are released. That is, the first rotation stop hook 54 and the second rotation stop hook 55 are configured to be engaged with the ribbon feeding core 42 and the ribbon winding core 43 to stop the rotation of the ribbon feeding core 42 and the ribbon winding core 43 only when the tape cartridge C is not mounted.

As illustrated in FIG. 3, the printing tape T is fed from the tape reel 41 inserted around the positioning protrusion 35, passes through a facing position between the printing head 31 and the platen roller 44, and then is fed to the tape discharge path 23 (a tape feeding path). On the other hand, the ink ribbon R is fed from the ribbon feeding core 42 fitted to the feeding-side driving shaft 34, passes through the facing position between the printing head 31 and the platen roller 44, circularly moves a peripheral wall of the head opening 51, and then is wound around the ribbon winding core 43 fitted to the winding-side driving shaft 33 (a ribbon feeding path).

In contrast, the platen roller 44 engaged with the platen driving shaft 32 feeds the printing tape T in a normal direction and a reverse direction by rotational driving while pressing the printing tape T and the ink ribbon R with the printing head 31. On the other hand, the ribbon winding core 43 engaged with the winding-side driving shaft 33 is rotationally driven in synchronization with normal feeding by the platen roller 44 to wind the ink ribbon R. Furthermore, the ribbon feeding core 42 engaged with the feeding-side driving shaft 34 is rotationally driven in synchronization with reverse feeding by the platen roller 44 to wind (rewind) the ink ribbon R. In this way, the normal and reverse feeding operation of the printing tape T and the ink ribbon R is performed.

In the label creation operation of the present embodiment, the printing tape T and the ink ribbon R are fed in the reverse direction, the distal end of the printing tape T is pulled back to a printing position by the printing head 31, and the printing head 31 is driven while feeding the printing tape T and the ink ribbon R in the normal direction to perform a printing process for the printing tape T, so that a printed part of the printing tape T is cut by the tape cutter 24 when the printing process is ended. In this way, a label with no space between the head and the cutter is created.

Hereinafter, with reference to FIG. 3 to FIG. 5, details of the winding-side driving shaft 33 and the feeding-side driving shaft 34 of the tape printer 1 and details of the ribbon feeding core 42 and the ribbon winding core 43 of the tape cartridge C will be described.

As illustrated in FIG. 3 and FIG. 4, the winding-side driving shaft 33 has a fixed shaft 61 and a spline shaft 62 rotatably and pivotally supported to the fixed shaft 61 and engaged with the ribbon winding core 43. The fixed shaft 61 is vertically installed in a base frame 60 arranged in the lower space of the bottom plate 21*a* of the cartridge mounting part 21. In the spline shaft 62, three spline protruding pieces 63 extending in the up and down direction are connected to the aforementioned feeding power system and protrude from three places in the circumferential direction. The distal end of each spline protruding piece 63 is formed in a tapered triangular pyramid shape. Although not illustrated, the spline shaft 62 has a tension spring therein. By this tension spring, the ribbon winding core 43 is rotationally urged in the winding direction via the spline shaft 62, so that constant tension is applied to the ink ribbon R between the ribbon winding core 43 and the ribbon feeding core 42.

The feeding-side driving shaft 34 has a fixed shaft 64 vertically installed in the base frame 60 and a spline shaft 65 rotatably and pivotally supported to the fixed shaft 64 and engaged with the ribbon feeding core 42, similarly to the winding-side driving shaft 33, wherein in the spline shaft 65, three spline protruding pieces 66 (spline convex parts) extending in the up and down direction are connected to the aforementioned feeding power system and protrude from three places in the circumferential direction. However, as illustrated in FIG. 4, the spline shaft 65 of the feeding-side driving shaft 34 is formed with a large diameter as compared with the spline shaft 62 of the winding-side driving shaft 33. The distal end of each spline protruding piece 66 is formed in a tapered triangular shape when viewed from the outside in the radial direction.

As described above, the spline shaft 62 of the winding-side driving shaft 33 and the spline shaft 65 of the feeding-side driving shaft 34 are connected to the feeding power system. Although not illustrated, the feeding power system has a single driving motor, and a power transfer mechanism that transfers power of the driving motor to the spline shafts 62 and 65. When the driving motor is rotated in the normal direction, the power of the driving motor is transferred to the spline shaft 62 of the winding-side driving shaft 33 by the power transfer mechanism, so that the spline shaft 62 is rotated. In this way, it is possible to rotate the ribbon winding core 43 which is engaged with the spline shaft 62. When the driving motor is rotated in the reverse direction, the power of the driving motor is transferred to the spline shaft 65 of the feeding-side driving shaft 34 by the power transfer mechanism, so that the spline shaft 65 is rotated. In this way, it is possible to rotate the ribbon feeding core 42 which is engaged with the spline shaft 65. As described above, the present embodiment has a configuration of rotationally driving the ribbon winding core 43 and the ribbon feeding core 42 by the single driving motor. The power transfer mechanism is also configured to transfer the power of the driving motor to the platen driving shaft 32, and the platen roller 44 engaged with the platen driving shaft 32 is also rotated by the rotation of the driving motor. In this way, it is possible to rotationally drive the winding-side driving shaft 33 and the feeding-side driving shaft 34 in synchronization with the rotational driving of the platen roller 44.

As illustrated in FIG. 3, the ribbon winding core 43 has a cylindrical core body 71 winding the ink ribbon R, and a plurality of spline-like engagement protruding pieces 72 (winding-side shaft engaging parts) protruding inward the core body 71 and engaged with the winding-side driving shaft 33. The plurality of engagement protruding pieces 72 and the three protruding pieces 63 of the winding-side driving shaft 33 are engaged with each other, so that the ribbon winding core 43 is engaged with the winding-side driving shaft 33. As illustrated in FIG. 4, the core body 71 is provided at the end portion thereof with a hook engaging part 73 protruding in the axial direction from an end surface of the core body 71 and engaged with the second rotation stop hook 55. That is, the hook engaging part 73 is configured to protrude inside the insertion opening 53, and the second rotation stop hook 55 is configured to stop the rotation of the ribbon winding core 43 in engagement with the hook engaging part 73 when the tape cartridge C is not mounted. The hook engaging part 73 is formed in a crown shape in which a plurality of convex and concave portions are arranged side by side in the circumferential direction.

Figure 5A:
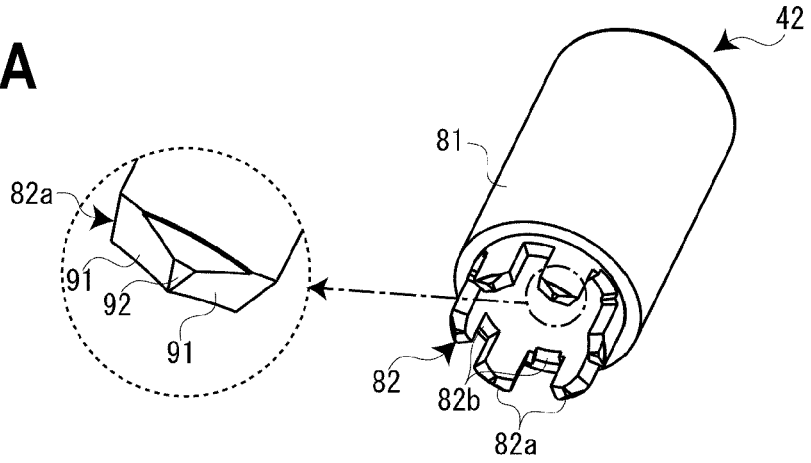
FIG. 5A is a rear surface perspective view illustrating a ribbon feeding core.

As illustrated in FIGS. 4 and 5A, the ribbon feeding core 42 has a cylindrical core body 81 winding the ink ribbon R, and a crown engaging part 82 (a shaft engaging part) formed at an end portion of the core body 81 and engaged with the feeding-side driving shaft 34. The crown engaging part 82 protrudes in the axial direction from an end surface of the core body 81 and is formed in a crown shape in which a plurality of convex portions 82*a* and concave portions 82*b* are alternately arranged side by side in the circumferential direction. The crown engaging part 82 and the spline protruding pieces 66 of the feeding-side driving shaft 34 are engaged with each other, so that the ribbon feeding core 42 is engaged with the feeding-side driving shaft 34. That is, each spline protruding piece 66 enters into any concave portion 82*b* of the crown engaging part 82, so that the ribbon feeding core 42 is engaged with the feeding-side driving shaft 34. The crown engaging part 82 also serves as an engaging part with which the first rotation stop hook 54 is engaged. That is, the crown engaging part 82 protrudes inside the insertion opening 52, and the aforementioned first rotation stop hook 54 is configured to stop the rotation of the ribbon winding core 43 in engagement with the crown engaging part 82 when the tape cartridge C is not mounted. Also in this case, the first rotation stop hook 54 is engaged with the ribbon feeding core 42 by entering into any concave portion 82*b* of the crown engaging part 82.

The distal end (the distal end portion in the aforementioned axial direction) of each convex portion 82*a* in the crown engaging part 82 is formed in a tapered trapezoidal shape when viewed from the outside in the radial direction. That is, the distal end of each convex portion 82*a* is formed at both corner portions thereof with a chamfer portion 91. The chamfer portion 91 serves as a guide slope (an introduction slope) that guides the spline protruding pieces 66 of the feeding-side driving shaft 34 into the concave portions 82*b* when the tape cartridge C is mounted to the tape printer 1. A flat surface 92 (an upper bottom surface of the trapezoidal shape) of each convex portion 82*a* serves as a reference surface which is used when the ribbon feeding core 42 is assembled to the tape cartridge C.

In the present embodiment, the engagement timing, at which (the plurality of engagement protruding pieces 72 of) the ribbon winding core 43 is engaged with the winding-side driving shaft 33, and the engagement timing, at which (the crown engaging part 82 of) the ribbon feeding core 42 is engaged with the feeding-side driving shaft 34, when the tape cartridge C is mounted to the tape printer 1 are configured to be different from each other. That is, each engagement protruding piece 72 of the ribbon winding core 43 and the crown engaging part 82 of the ribbon feeding core 42 are formed such that the aforementioned both engagement timings are different from each other. Specifically, each engagement protruding piece 72 and the crown engaging part 82 are formed such that the ribbon winding core 43 is engaged with the winding-side driving shaft 33 and then the ribbon feeding core 42 is engaged with the feeding-side driving shaft 34. Each engagement timing is adjusted by the heights of each engagement protruding piece 72 and the crown engaging part 82.

The aforementioned present embodiment has a configuration in which the ribbon feeding core 42 is engaged with the feeding-side driving shaft 34 by the crown engaging part 82 protruding from the end surface of the core body 81, so that it is possible to allow the ribbon feeding core 42 to be engaged with the feeding-side driving shaft 34 at the outside in the radial direction as much as possible. In this way, it is possible to move an engagement position between the ribbon feeding core 42 and the feeding-side driving shaft 34 to the outside in the radial direction without enlarging the ribbon feeding core 42 in the radial direction. In this way, the ink ribbon R can be appropriately rewound on the ribbon feeding core 42.

Furthermore, the chamfer portion 91 serving as a guide slope is formed at the distal end of each convex portion 82*a* in the crown engaging part 82, so that it is possible to allow the ribbon feeding core 42 to be smoothly engaged with the feeding-side driving shaft 34 when the tape cartridge C is mounted to the tape printer 1.

Moreover, the crown engaging part 82 is also used as an engaging part with which the first rotation stop hook 54 is engaged, so that it is possible to simplify the configuration of the tape cartridge C.

Moreover, each engagement protruding piece 72 and the crown engaging part 82 are formed such that the engagement timing, at which the crown engaging part 82 is engaged with the feeding-side driving shaft 34, and the engagement timing, at which each engagement protruding piece 72 is engaged with the winding-side driving shaft 33, when the tape cartridge C is mounted to the tape printer 1 are different from each other, so that it is possible to avoid the engagement of the crown engaging part 82 with respect to the feeding-side driving shaft 34 and the engagement of each engagement protruding piece 72 with respect to the winding-side driving shaft 33 from being simultaneously performed when the tape cartridge C is mounted to the tape printer 1. In this way, it is possible to avoid a problem that a heavy load occurs in the ink ribbon R or each engagement is not normally performed due to simultaneous generation of force for allowing the crown engaging part 82 to be engaged with the feeding-side driving shaft 34 and force for allowing each engagement protruding piece 72 to be engaged with the winding-side driving shaft 33.

Figure 5B:
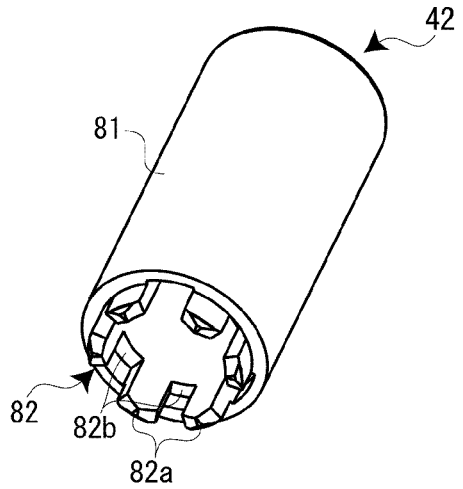
FIG. 5B is a rear surface perspective view illustrating a first modification example of a ribbon feeding core.

In the present embodiment, as illustrated in FIG. 5A, the bottom surface of each concave portion 82*b* in the crown engaging part 82 is configured to be positioned axially outward from the end surface of the core body 81; however, as illustrated in FIG. 5B, the bottom surface of each concave portion 82*b* may be configured to be positioned axially inward from the end surface of the core body 81. In addition, the ribbon feeding core 42 illustrated in FIG. 5A is employed to a tape cartridge C that receives a printing tape T having a tape width of 18 mm or less, and the ribbon feeding core 42 illustrated in FIG. 5B may be employed to a tape cartridge C that receives a printing tape T having a tape width of 24 mm.

Figure 5C:
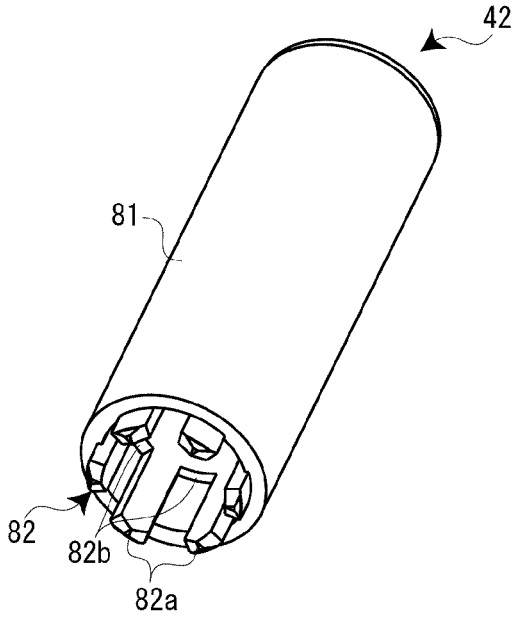
FIG. 5C is a rear surface perspective view illustrating a second modification example of a ribbon feeding core.

Furthermore, although not mentioned in the aforementioned present embodiment, there is a case in which the mounting position in the height direction differs depending on the type of the tape cartridge C. In this regard, it is preferred to change the depth of each concave portion 82*b* according to the difference of the mounting position. For example, a tape cartridge C for receiving a printing tape T having a tape width of 36 mm is mounted at a position lower than that of the tape cartridge C for receiving the printing tape T having a tape width of 18 mm or less described in the aforementioned present embodiment. However, in the ribbon feeding core 42 of the tape cartridge C for receiving the printing tape T having a tape width of 36 mm, the depth of each concave portion 82*b* is deepened as illustrated in FIG. 5C as compared with FIG. 5A. That is, the bottom surface of each concave portion 82*b* is allowed to be positioned axially inward as compared with FIG. 5A.

In the present embodiment, the configuration including the core body 81 and the crown engaging part 82 is applied to the ribbon feeding core 42; however, the configuration may be applied to the ribbon winding core 43. In addition, the configuration may be applied to both the ribbon feeding core 42 and the ribbon winding core 43.

REFERENCE SIGNS LIST

1: tape printer
33: winding-side driving shaft
34: feeding-side driving shaft
42: ribbon feeding core
43: ribbon winding core
54: first rotation stop hook
72: engagement protruding piece
81: core body

82: crown engaging part
82*a*: convex portion
82*b*: concave portion
91: chamfer portion
C: tape cartridge
R: ink ribbon

The invention claimed is:

1. A tape cartridge for mounting to a tape printer, comprising:

a ribbon feeding core on which an ink ribbon is wound for being fed, the ribbon feeding core including:

a core body that winds the ink ribbon; and a shaft engaging part formed at an end portion of the core body, the shaft engaging part being configured to engage a feeding-side driving shaft of the tape printer when the tape cartridge is mounted to the tape printer, the shaft engaging part protruding in an axial direction of the core body from an end surface of the core body and having a crown shape in which a plurality of convex portions and a plurality of concave portions are alternately arranged side by side in a circumferential direction, each convex portion being disposed at a distal end portion in the axial direction with a guide slope configured to guide a spline convex part of the feeding-side driving shaft into the concave portion when the tape cartridge is mounted to the tape printer, and the shaft engaging part engaging a rotation stop part that stops rotation of the ribbon feeding core when the tape cartridge is not mounted to the tape printer, a bottom surface of each concave portion being positioned axially inward from the end surface of the core body; and a ribbon winding core that winds the ink ribbon fed from the ribbon feeding core.

2. The tape cartridge according to claim 1, wherein the ribbon winding core has a winding-side shaft engaging part configured to engage a winding-side driving shaft of the tape printer, and the shaft engaging part and the winding-side shaft engaging part are configured such that when the tape cartridge is mounted to the tape printer, a feeding engagement timing at which the shaft engaging part is engaged with the feeding-side driving shaft, and a winding engagement timing at which the winding-side shaft engaging part is engaged with the winding-side driving shaft, are different from each other.

3. The tape cartridge according to claim 1, wherein each of the plurality of convex portions is formed in a tapered trapezoidal shape when viewed from an outside in a radial direction, the trapezoidal shape comprises an upper bottom surface and chamfer portions at both corner portions of the upper bottom surface, and the chamfer portions serve as guide slopes.

4. The tape cartridge according to claim 3, wherein the upper bottom surface serves as a reference surface which is used when the ribbon feeding core is assembled to the tape cartridge.

* * * * *